US011112217B1

(12) United States Patent
Neel et al.

(10) Patent No.: US 11,112,217 B1
(45) Date of Patent: Sep. 7, 2021

(54) WEAPON MOUNTABLE ILLUMINATION DEVICE

(71) Applicant: In-Extremis Design and Development, LLC, Foxfield, CO (US)

(72) Inventors: Ryan Neel, Foxfield, CO (US); Dennis DeBobes, Foxfield, CO (US); Jeffrey Jakubowski, Littleton, CO (US)

(73) Assignee: IN-EXTREMIS DESIGN AND DEVELOPMENT, LLC, Foxfield, CO (US)

( * ) Notice: Subject to any disclaimer, the term of this patent is extended or adjusted under 35 U.S.C. 154(b) by 0 days.

(21) Appl. No.: 16/906,698

(22) Filed: Jun. 19, 2020

(51) Int. Cl.
*F41G 1/35* (2006.01)
*F41G 11/00* (2006.01)
*F41H 13/00* (2006.01)

(52) U.S. Cl.
CPC ..... *F41G 11/003* (2013.01); *F41G 1/35* (2013.01); *F41H 13/0056* (2013.01)

(58) Field of Classification Search
CPC ..... F41G 1/34; F41G 1/32
See application file for complete search history.

(56) References Cited

U.S. PATENT DOCUMENTS 2,085,732 A * 7/1937 Baxter ..... F41G 1/35 362/114
4,856,218 A * 8/1989 Reynolds, Jr. ..... F41G 1/345 42/146
5,064,988 A * 11/1991 E'nama ..... F41G 1/35 219/121.6
5,704,155 A * 1/1998 Primeau, IV ..... F41G 1/35 362/110
5,822,905 A * 10/1998 Teetzel ..... F41G 1/36 42/117
5,913,669 A * 6/1999 Hansen ..... F41G 1/36 42/146
7,264,369 B1 * 9/2007 Howe ..... F41G 1/35 200/50.32
7,827,726 B2 * 11/2010 Stokes ..... F41H 13/0056 42/146
7,954,273 B1 * 6/2011 Swan ..... F41G 1/35 42/115
8,001,715 B2 * 8/2011 Stokes ..... F41G 1/35 42/146
8,201,353 B1 * 6/2012 Swan ..... F41G 11/003 42/71.01
8,256,153 B1 * 9/2012 Noha ..... F41G 1/35 42/117
8,459,822 B1 * 6/2013 Lambert ..... F41G 1/473 362/110
8,484,882 B2 * 7/2013 Haley ..... F41G 1/36 42/132

(Continued)

FOREIGN PATENT DOCUMENTS

WO WO-2015105677 A1 * 7/2015 ..... F41G 1/35

*Primary Examiner* — Derrick R Morgan
(74) *Attorney, Agent, or Firm* — Voz Patents, LLC

(57) ABSTRACT

A weapon mountable illumination device configured to mount to existing firearm mounting rails to provide illumination of potential targets while mitigating problems associated with snagging, and shadow casting. It is an aspect of the present invention to provide a rapidly mountable device to provide increased lighting capability while obviating the need to remove back up iron sights.

18 Claims, 9 Drawing Sheets

(56) References Cited

U.S. PATENT DOCUMENTS 8,683,733 B2 * 4/2014 Gross ..... F41G 11/003 42/146
8,739,447 B2 6/2014 Merritt et al.
9,062,933 B1 * 6/2015 Allen ..... F21V 21/34
9,546,848 B1 * 1/2017 Burger, Sr. ..... F41H 13/0025
9,851,083 B2 * 12/2017 Pinilla ..... F41C 23/16
9,958,226 B2 5/2018 Merritt et al.
10,060,698 B2 * 8/2018 Mehki ..... F41G 1/35
10,082,363 B2 * 9/2018 Burgess ..... F41G 11/003
10,215,530 B1 * 2/2019 Watts ..... F41G 1/35
10,436,552 B2 * 10/2019 Gray ..... F41G 1/35
10,955,217 B2 * 3/2021 Saadon ..... F41C 23/16
10,969,201 B1 * 4/2021 Pischke ..... F41G 1/34
2002/0100204 A1 * 8/2002 Kim ..... F41G 1/35 42/146
2003/0226305 A1 * 12/2003 Burnett ..... F41G 3/165 42/90
2005/0188827 A1 * 9/2005 McNulty, Jr. ..... F41B 15/04 89/1.11
2006/0010761 A1 * 1/2006 Staley, III ..... F41G 1/48 42/142
2007/0039225 A1 * 2/2007 Kallio ..... F41G 1/35 42/146
2007/0039226 A1 * 2/2007 Stokes ..... F41G 1/35 42/146
2007/0137087 A1 * 6/2007 Florea ..... F41G 11/004 42/90
2009/0122527 A1 * 5/2009 Galli ..... F41G 1/35 362/110
2010/0154280 A1 * 6/2010 LaFrance ..... F41H 5/12 42/124
2011/0131859 A1 * 6/2011 Lawson ..... F41G 11/004 42/90
2011/0255270 A1 * 10/2011 Gross ..... F41G 1/36 362/110
2012/0055061 A1 * 3/2012 Hartley ..... F41C 23/16 42/84
2012/0140201 A1 * 6/2012 Grauslys ..... G01S 7/4813 356/4.01
2012/0180366 A1 * 7/2012 Jaroh ..... F41G 3/06 42/114
2012/0268920 A1 * 10/2012 Matthews ..... F41G 11/003 362/110
2013/0036646 A1 * 2/2013 Rubac ..... F41C 23/16 42/90
2013/0133236 A1 5/2013 Merritt et al.
2014/0317988 A1 * 10/2014 Battis ..... F41G 1/35 42/114
2015/0233668 A1 * 8/2015 Moore ..... F41G 1/35 42/72
2015/0247703 A1 * 9/2015 Teetzel ..... G01S 17/08 356/5.01
2015/0276352 A1 * 10/2015 Chang ..... F41G 1/36 42/114
2015/0300386 A1 * 10/2015 Fong ..... F16M 11/041 24/505
2016/0010949 A1 * 1/2016 Teetzel ..... F41G 1/473 42/115
2016/0033232 A1 * 2/2016 Cheng ..... F41G 1/345 42/114
2016/0061560 A1 * 3/2016 Saadon ..... F41C 23/16 42/72
2016/0102943 A1 * 4/2016 Teetzel ..... B27B 5/36 42/113
2016/0161214 A1 * 6/2016 Eble ..... F41G 11/003 42/90
2017/0038178 A1 2/2017 Pinilla
2017/0159921 A1 6/2017 Morris
2017/0205202 A1 * 7/2017 Teetzel ..... F41G 11/003
2017/0268849 A1 * 9/2017 Conner ..... F21V 23/04
2017/0276452 A1 * 9/2017 Barnette ..... F41G 11/004
2018/0094900 A1 * 4/2018 Sharrah ..... F41A 19/11
2018/0142991 A1 * 5/2018 Rogers ..... F41G 11/004
2018/0219349 A1 * 8/2018 Lemire ..... H01S 3/02
2018/0292170 A1 * 10/2018 Gagliano ..... F41G 1/467
2019/0049221 A1 * 2/2019 Zimmer ..... F41G 1/36
2020/0132414 A1 * 4/2020 Shelton ..... F41G 1/033
2020/0200508 A1 * 6/2020 Teetzel ..... F41G 11/003
2020/0232737 A1 * 7/2020 McClellan ..... F41A 17/063
2020/0240750 A1 * 7/2020 Reed ..... F41G 1/35
2020/0363160 A1 * 11/2020 Pigott ..... F41G 3/04
2021/0088310 A1 * 3/2021 Planck ..... F41G 11/003

* cited by examiner

WEAPON MOUNTABLE ILLUMINATION DEVICE

FIELD OF THE INVENTION

The present invention is directed to a weapon mountable illumination device which is intended to provide a modular and mobile lighting solution which mitigates problems associated with snagging, shadow casting, imbalance associated with the mounting to a weapon, and overheating of elements.

BACKGROUND OF THE INVENTION

In the conduct of law enforcement and military operations, weapon-mounted tactical lighting has become mission critical equipment in most operations wherein such equipment provides a high level of value in achieving success in a given operation.

Handheld tactical lighting, generally used with pistols, requires the use of one hand to operate the weapon while the other hand of the operator is used to illuminate targets or areas of interest beyond the muzzle-end of the weapon.

Weapon-mounted lighting, commonly used with long guns (shotguns, rifles, carbines, and other longer barreled firearms) allows the use of both hands in operating the weapon while providing illumination to targets or areas of interest beyond the muzzle-end of the weapon. Although weapon-mounted lighting is typically used with long guns which require two-handed operation, weapon-mounted lighting has also been adapted for use on pistols.

Weapon-mounted lighting in weapon centric operations allows an operator—a commonly used term for personnel involved in military operations—to provide illumination generally in the direction of the muzzle of the weapon while maintaining use of both hands for weapon handling and other operation related tasks.

Benefits of weapon-mounted lighting typically include: positive target identification in low-light situations, disorientation and/or temporary blinding of targets, or emitting infrared light for the purposes of illumination of areas in the event the operator is using night-vision enabling equipment.

SUMMARY OF THE INVENTION

An existing solution surrounding weapon-mounted lighting involves the mounting of a traditionally-shaped, cylindrical flashlight to the side of the weapon. Due to the placement of the flashlight on the side of the weapon, this can result in the casting of a shadow on the opposite side of the barrel from where the flashlight is mounted. A shadow in low-light operations can result in a potential target or threat being obscured from illumination, thus creating a potentially life-threatening situation for the operator.

A common tactic in efforts to mitigate the casting of a shadow involves the mounting of the flashlight as far forward and closer to the muzzle-end of the weapon, such as seen in U.S. Pat. No. 7,941,960 to Matthews, et al. ("Matthews")—incorporated in its entirety herein for all purposes. Although this decreases the casting of shadows, this results in negatively affecting the weapon's weight and balance. Resultantly, the operator's ability to accurately engage targets is also negatively affected. Furthermore, the mounting of a flashlight toward the muzzle-end of a weapon creates a protuberance which can result in the snagging or catching of the weapon on obstacles including, but not limited to, communication cords, pistol lanyards, seatbelts, wires, or other cable-like lines present in military and/or law enforcement vehicles, boats, and aircraft. While conducting vehicle-mounted operations, it is optimal for an operator to be able to exit the vehicle quickly and bring the weapon to bear with zero interference. Prior art illumination devices (i.e. externally attached cylindrical flashlight-shaped devices) serve as a prominent encumbrance to speed and accuracy. The positioning of a standard external flashlight is such that the vehicle seatbelt or harness will likely clear the barrel of the gun, but grab the light fixture, causing not only a delayed exit, but more importantly a negative impact to the operator's ability to accurately engage threats. Operators have reported incidents of weapon-mounted flashlights catching on obstacles during ship-boarding operations, close-quarters combat operations, room-clearing operations, and during rappelling operations from buildings or fast-rope operations from helicopters. An operator catching their weapon in any operation can pose a life-threatening risk. For instance, during a rappelling or fast-rope operation, the catching of one's weapon can result in an uncontrolled fall from heights in excess of 40 feet.

Embodiments of the present invention surround a weapon-mounted illumination device providing lighting for an operator in a manner which does not cast shadows and provides streamlined form factor which provides snag-free operation due to the form factor in close proximity with existing aspects of the weapon.

Solutions to the above discussed problems have been proposed involving the mounting of a lighting device, such as a flashlight, to a weapon aligned with the muzzle-end of the firearm. The problem with such solutions surrounds the percussion and heat associated with the repeated firing of the firearm. The percussion and heat adversely affect the performance of the lighting device, as well as the operation of the weapon. The side-mounting of a flashlight to the forward aspect of a weapon may negatively affect the intended operation of the weapon due to imbalance and result in weapon malfunction.

A rail interface system—commonly referred to as a "rail", "rail integration system", "rail accessory system"—is a standardized apparatus of the attachment of accessories to firearms. Rail interface systems commonly provide a handguard offset surface of a barrel, wherein the handguard has one or more rails in accordance with MIL-STD-1913, STANAG 4694 specifications, or other rail interface systems known to those skilled in the art. The rail interface system allows the rapid attachment of accessories to a firearm by sliding the accessory onto a rail having undercuts, resulting in a T-shaped rail, and locked into place. A commonly used rail interface system for carbine weapons, such as the M-4, M-16, and AR-15, is commonly referred to as a "Picatinny Rail" although embodiments of the present invention are configured to interconnect with all rail accessory systems known to those skilled in the art. Certain rail interface systems provide handguard, configured to mount axially around a barrel of a firearm, having a total of four rails angularly offset at 90-degree increments, resulting in an octagonal profile wherein alternating surfaces have an accessory rail such that a top surface, bottom surface, left surface, and right surface of the handguard have accessory rails. It is an aspect of certain embodiments to provide an illumination device configured to slidably mount to a rail interface system having an octagonal profile. It is an aspect of certain embodiments of the present invention to be slidably mountable to a rail integration system having at least one rail integration system.

Certain existing technologies, such as U.S. Patent Publication No. 2017/0038178 to Pinilla ("Pinilla"), herein incorporated by reference in its entirety for all purposes, propose a solution wherein a lighting device is integrated into a rail interface system. Pinilla teaches the incorporation of an illumination device within an internal aspect of a rail interface system wherein lighting elements are disposed between the rail interface system and the placement of the batteries creating a protuberance above where a top rail of the rail interface system would otherwise be. Furthermore, the removal of the illumination device of Pinilla requires the removal of the rail interface system as opposed to the removal of the illumination device alone. The close proximity of electrical and battery elements to the barrel would result in the exposure of electrical elements and batteries to high heat and percussion. Furthermore, the protuberance of the battery compartment negates the use of the top rail of the rail interface system and precludes the mounting of certain accessories to the weapon.

It is an aspect of the present invention to provide a weapon-mounted illumination device which is modular and does not limit the mounting of accessories to a rail interface system when the illumination device is not necessary. It is a further aspect of the present invention to allow the mounting of an illumination device as desired—toward the forward end (muzzle end) of the weapon, or further aft, dependent on the operator's preference or arm length and other physical body characteristics without impediment to or front existing elements such as back-up iron sights. It is a further aspect of the present invention to allow the attachment and removal of an illumination device without requiring the removal of the front-sight post.

It is an aspect of the present invention that the mounting of an illumination device mounted to a weapon's rail interface system does not inhibit or interfere with the mounting or operational use of traditional sights such as Backup Iron Sights (BUIS) or other commonly used sighting systems including, but not limited to products manufactured by: Aimpoint®, ACOG®, EOTECH® or AR-Scopes®.

It is a further aspect of the present invention to maintain the functionality of the top rail of a rail interface system when an illumination device is mounted to the weapon's rail interface system. Certain embodiments of the present invention surround the use of a cuff form having an open top aspect wherethrough the top aspect of a firearm is received. This allows an operator to rapidly affix or remove the present invention from the firearm without impediment to or from aspects of the weapon such as backup iron sights, the slide of a semi-automatic pistol, or accessories mounted to the top aspect of the weapon using a rail interface system.

Existing solutions, such as Pinilla, teach the use of a wired remote illumination activation switch which is placed remotely from the illumination device in close proximity to the operator's hands, such as near the trigger-guard of the weapon. Such switches may result in unintentional activation of the illumination device which may inadvertently alert a target to the presence of an operator during covert operations, or reduce the visual acuity of a fellow operator resulting in potentially dangerous circumstances.

It is an aspect of the present invention to provide an illumination device wherein activation switches are configured in a manner which mitigates accidental actuation to prevent the inadvertent turning of the illumination device on or off. Switches of certain embodiments are integrated into the weapon mountable illumination device to provide tactile control of power and alternative functions of the weapon mountable illumination device. Certain embodiments include switches on both the left side and the right side of the weapon mountable illumination device thereby allowing the ambidextrous functionality during operations.

It is an aspect of the present invention to provide a power indicator to an operator in a manner which is seen only by the operator in a non-distracting manner. Certain embodiments comprise a pin-hole sized blue-light facing rearward such that the blue power indicator is viewable by an operator when the weapon is held in a firing position.

It is an aspect of certain embodiments to provide annular or semi-annular lighting as opposed to individual beam configurations as found with a flashlight mounted on the side of a weapon. Annular lighting provides lighting from 360-degrees around the barrel of the weapon and illuminates beyond the muzzle-end of the weapon. As such, an annular lighting solution negates the shadow casting effects of a beam lighting configuration. It will be appreciated that annular lighting, for the purposes of this instant application includes but is not limited to the use of a continuous annular lighting element, a plurality of lighting elements (such as LEDs) disposes at radial intervals surrounding the barrel of a weapon, or one or more lighting elements configured to distribute illumination around the barrel of the weapon.

It is an aspect of the present invention to provide a weapon mountable illumination device which mitigates shadow casting though the use of a plurality of lighting elements configured to provide illumination forward of a firearm and operator. It will be appreciated that the term "forward" as used herein is not limited to a unidirectional aspect, but all aspects which are forward of the weapon and operator including a hemispherical field of view. It is an aspect of certain embodiments that a plurality of lighting elements work in concert to provide illumination forward of the firearm in a manner that the light cast provides a harmonized and/or uninterrupted lighting effect.

A further aspect of certain embodiments of the present invention include multiple functionalities such as, but not limited to: strobing, pattern flashing, white light, infrared illumination, colored LED light such as red or green light, and less-lethal functionality such as those taught by U.S. Pat. No. 6,190,022 to Tocci, et al. ("Tocci") incorporated herein in its entirety for all purposes. It is a further aspect of certain embodiments to allow the selection of particular modes through the use of a selector switch.

It is an aspect of the present invention to allow the operation of a laser independently of a lighting element. It is a further aspect of the present invention to allow the selection of a first mode of the operation of the laser and lighting elements wherein contacting or depressing the respective switch toggles the laser or lighting element on until the switch is contacted again. Another aspect of the present invention allows the selection of a second mode of the operation of the laser and lighting elements wherein contacting or depressing the respective switch toggles the laser or lighting element on until the respective switch is released. Yet another aspect of the present invention allows the selection of a second mode of the operation of the laser and lighting elements wherein contacting or depressing the respective switch does not illuminate the laser or lighting element thereby preventing inadvertent illumination as may be desired in clandestine operations or simply to conserve battery power.

Certain embodiments of the present invention comprise an illumination device mountable to a rail interface system wherein the illumination device is independent of a weapon foregrip and mounted adjacent to the barrel, while embodiments comprising an integrated foregrip for a weapon are within the spirit and scope of the present invention.

Embodiments of the present invention comprise an illumination device manufactured from aluminum, durable polymers, composites and/or rubber. It will be appreciated however, that embodiments constructed with alternative materials known to those skilled in the art are within the scope and spirit of the present invention.

It is an aspect of certain embodiments to provide an illumination device which is neutrally buoyant such that when used in water-based operations, the illumination device does not affect the buoyancy of the weapon and system of accessories in a positive or negative manner.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1A:
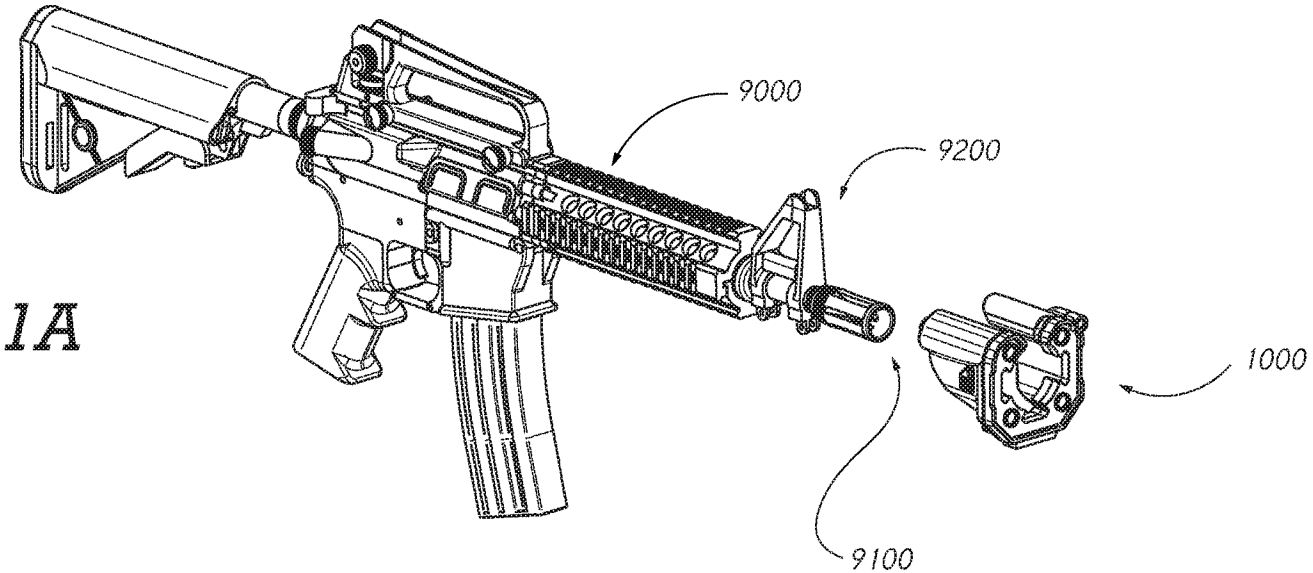
FIG. 1A—An exploded perspective view of certain embodiments of a weapon mountable illumination device for assembly with a firearm FIG. 1B—A perspective view of certain embodiments of a weapon mountable illumination device assembled with a firearm FIG. 2A—A front view of certain embodiments of a weapon mountable illumination device FIG. 2B—A rear view of certain embodiments of a weapon mountable illumination device FIG. 3A—A front view of certain embodiments of a weapon mountable illumination device FIG. 3B—A front view detail of certain embodiments of a weapon mountable illumination device shown in FIG. 3A FIG. 3C—A front view of certain embodiments of a weapon mountable illumination device assembled with a firearm FIG. 4—A front perspective view of certain embodiments of a weapon mountable illumination device FIG. 5—A system representation of certain embodiments of a weapon mountable illumination device FIG. 6—A rear perspective view of certain embodiments of a weapon mountable illumination device FIG. 7A—A top view of certain embodiments of a weapon mountable illumination device FIG. 7B—A bottom view of certain embodiments of a weapon mountable illumination device FIG. 7C—A left side view of certain embodiments of a weapon mountable illumination device FIG. 7D—A right side view of certain embodiments of a weapon mountable illumination device
Figure 1B:
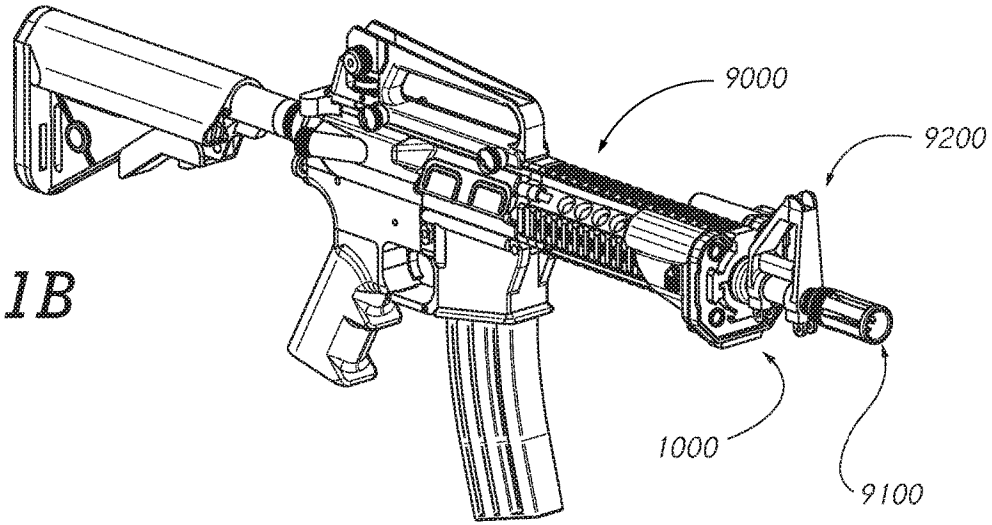

Certain embodiments of the present invention, such as shown in FIG. 1A-FIG. 1B, comprise a weapon mountable illumination device 1000 configured to slidably affix to the forward end of a firearm 9000 for providing illumination toward a forward 9100, or muzzle end, of the firearm 9000.

Figure 2A:
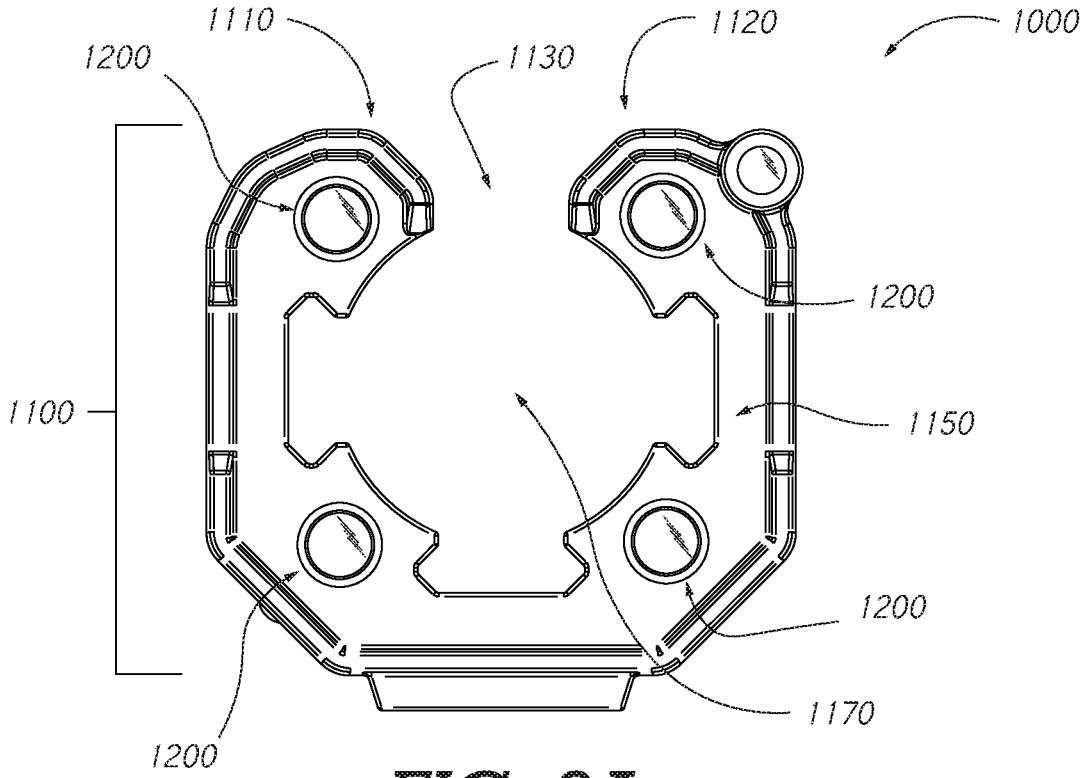
Figure 2B:
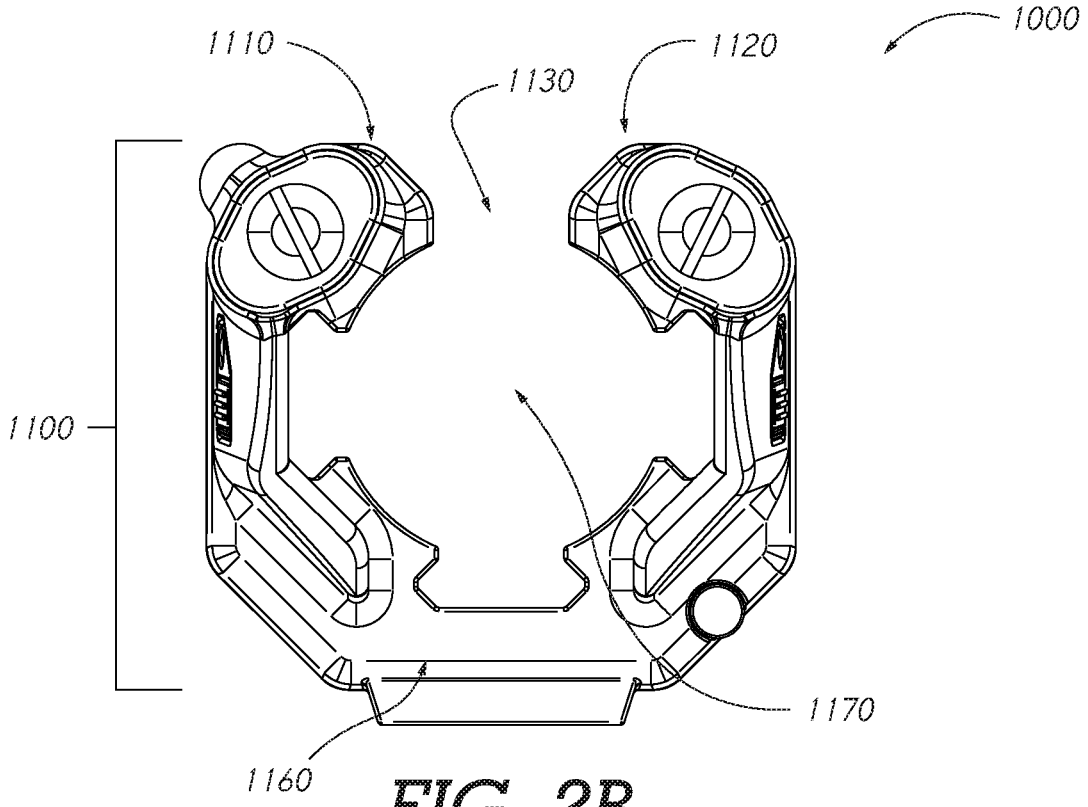

Certain embodiments comprise a weapon mountable illumination device 1000, as seen in FIG. 2A-FIG. 2B, which has a cuff form 1100 wherein the cuff form has a first end 1110, a second end 1120, and a gap 1130 disposed therebetween. The weapon mountable illumination device 1000 comprises a first open side 1150, a second open side 1160, and a pathway 1170 there between. The gap 1130 of the cuff form is configured to allow the mounting to a firearm 9000, now referencing FIG. 1A-FIG. 1B, without impediment to or from existing elements of the firearm such as fixed iron sights 9200 or backup iron sights (BUIS), a slide of a semi-automatic pistol, or other aspects, or accessories mounted to a top aspect of a firearm such as those mounted to a rail system.

Certain embodiments of a weapon mountable illumination device 1000, as seen in FIG. 2A-FIG. 2B, comprise at least one lighting element 1200 configured to shine in a forward direction, while certain embodiments comprise a plurality of lighting elements 1200. Further embodiments still comprise a singular lighting element configured to provide annular or semi-annular lighting.

Figure 3A:
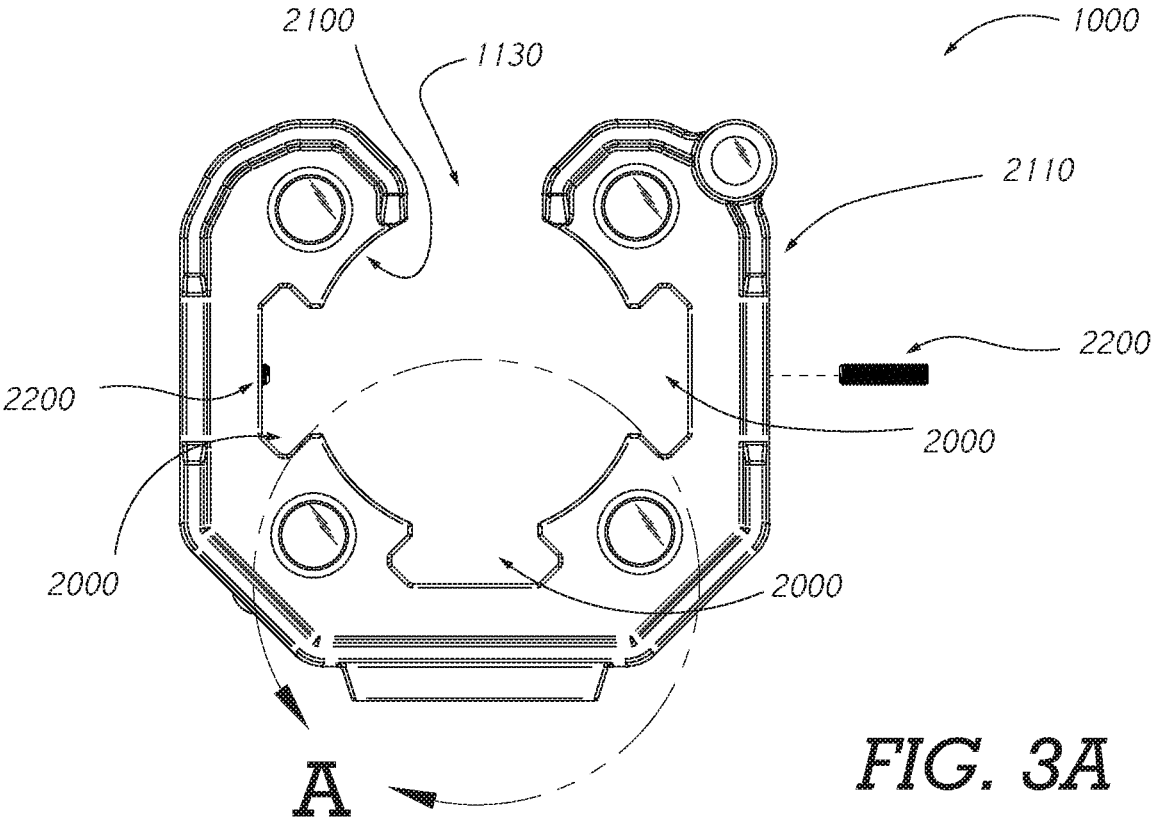

Certain embodiments of the present invention, such as shown in FIG. 3A, comprise a weapon mountable illumination device having a first channel 2000 in an internal perimeter 2100 of the cuff form 1100. The channel 2000 has an angular offset of 180-degrees from the gap 1130 of the cuff form 1100. The channel 2000 is configured to allow the slidable interconnection and removal of the weapon mountable illumination device 1000 to and from a firearm 9000 (FIG. 1A-FIG. 1B).

In certain embodiments, again referencing FIG. 3A, the cuff form 1130 further comprises a set screw 2200 extending from an external perimeter 2110 of the cuff form through the internal perimeter of the cuff form. The set screw 2200 is configured to extend radially inward from the internal perimeter 2100 of the cuff form and engage with the firearm, thereby affixing the weapon mountable illumination device to the firearm. Certain embodiments within the spirit and scope of the present invention comprise a plurality of set screws 2200. It will be appreciated by those skilled in the art that the attachment of a weapon mountable illumination device is not limited to the use of set screws 2200. Embodiments comprising elements configured to be threadably advanced, slidably advanced, or through the use of spring-loaded elements such as ball detents to engage with a firearm, aspects of a rail interface system, or elements thereof are within the spirit and scope of the present invention. It will be further appreciated that the use of quick-disconnect elements such as disclosed in U.S. Pat. No. 7,823,315 to Webber et al. ("Webber"), U.S. Pat. No. 8,857,097 to Rorick ("Rorick"), U.S. Pat. No. 8,336,247 to Haering ("Haering"), and U.S. Pat. No. 8,397,421 to Ding, et al. (Ding")—each of which are incorporated herein in its entirety for all purposes, are within the spirit and scope of the present invention.

Figure 3B:
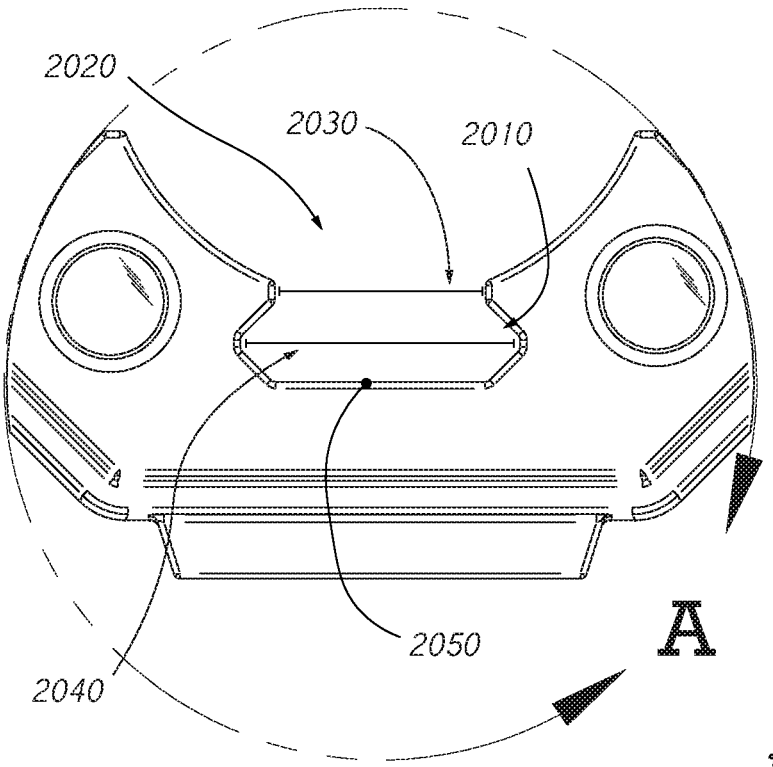
Figure 3C:
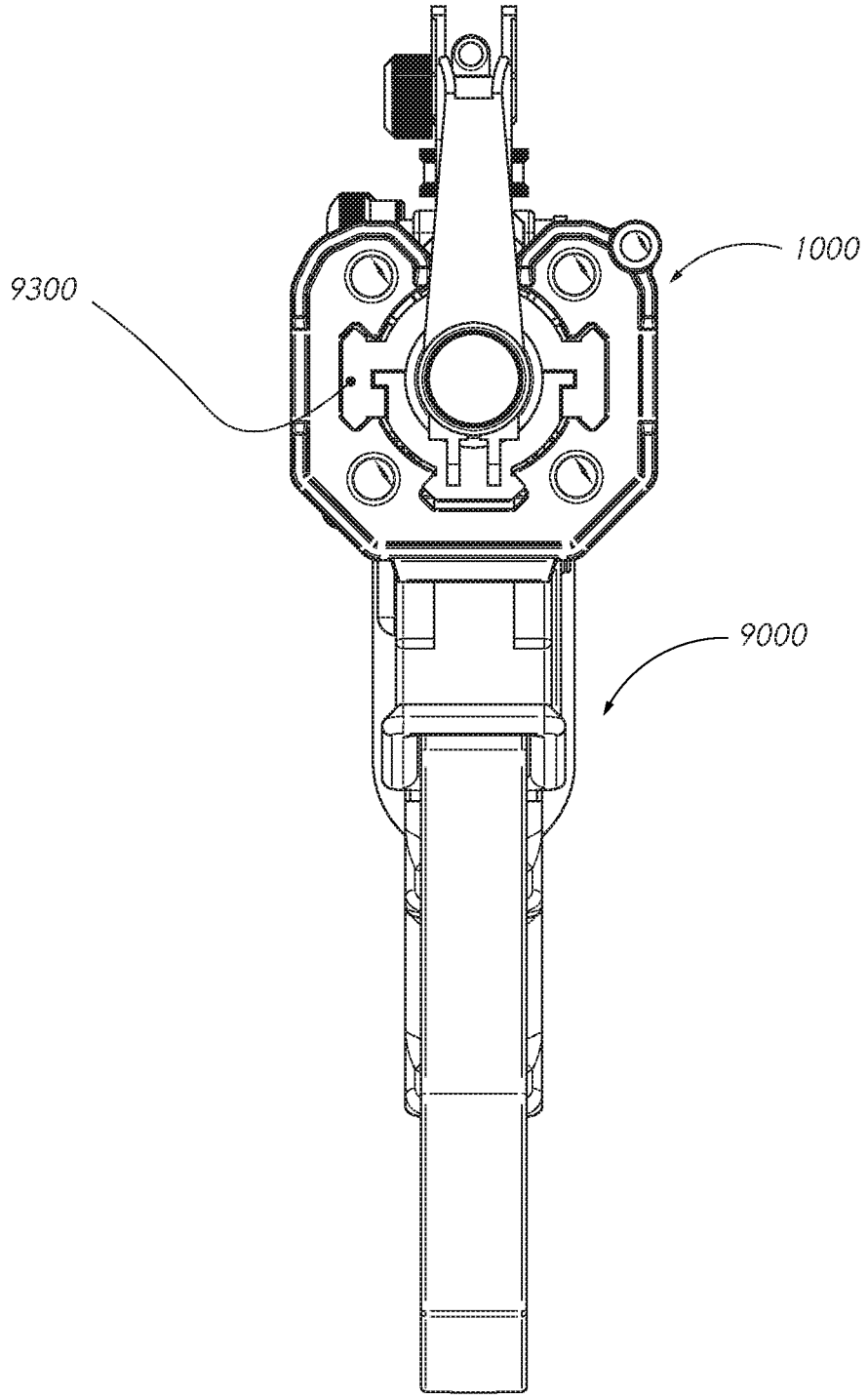

In certain embodiments, as shown in FIG. 3A-FIG. 3C, a weapon mountable illumination device 1000 comprises a channel 2000 configured to receive a rail interface system 9300. A rail interface system as disclosed herein refers to MIL-STD-1913, STANAG 4694 specifications, as well as any rail interface system known to those skilled in the art.

In certain embodiments, shown in FIG. 3A-FIG. 3C, a weapon mountable illumination device comprises a channel 2000 having undercut sidewalls 2010. It will be appreciated that undercut, as used herein refers to a manufacturing "undercut" resulting in a recessed surface that is inaccessible using a straight tool. In certain embodiments, a channel having undercut sidewalls 2010 is characterized by having an opening 2020 of a first width 2030, and a second width 2040 located between the opening and the bottom 2050 of the channel, wherein the second width is greater than the first width.

Certain embodiments, such as shown in FIG. 3A, comprise a plurality of channels 2000 angularly offset from each other around the internal perimeter of the cuff form. Certain embodiments comprise three channels 2000 angularly offset around the internal perimeter 2100 of the cuff form at intervals of 90-degrees, 180-degrees, and 270-degrees offset from the gap of the cuff form. It will be appreciated that alternate embodiments of the plurality of channels comprising straight walls, walls without undercuts, undercut sidewalls, and embodiments wherein some channels comprise undercut sidewalls while others do not, are within the spirit and scope of the present invention.

Figure 4:
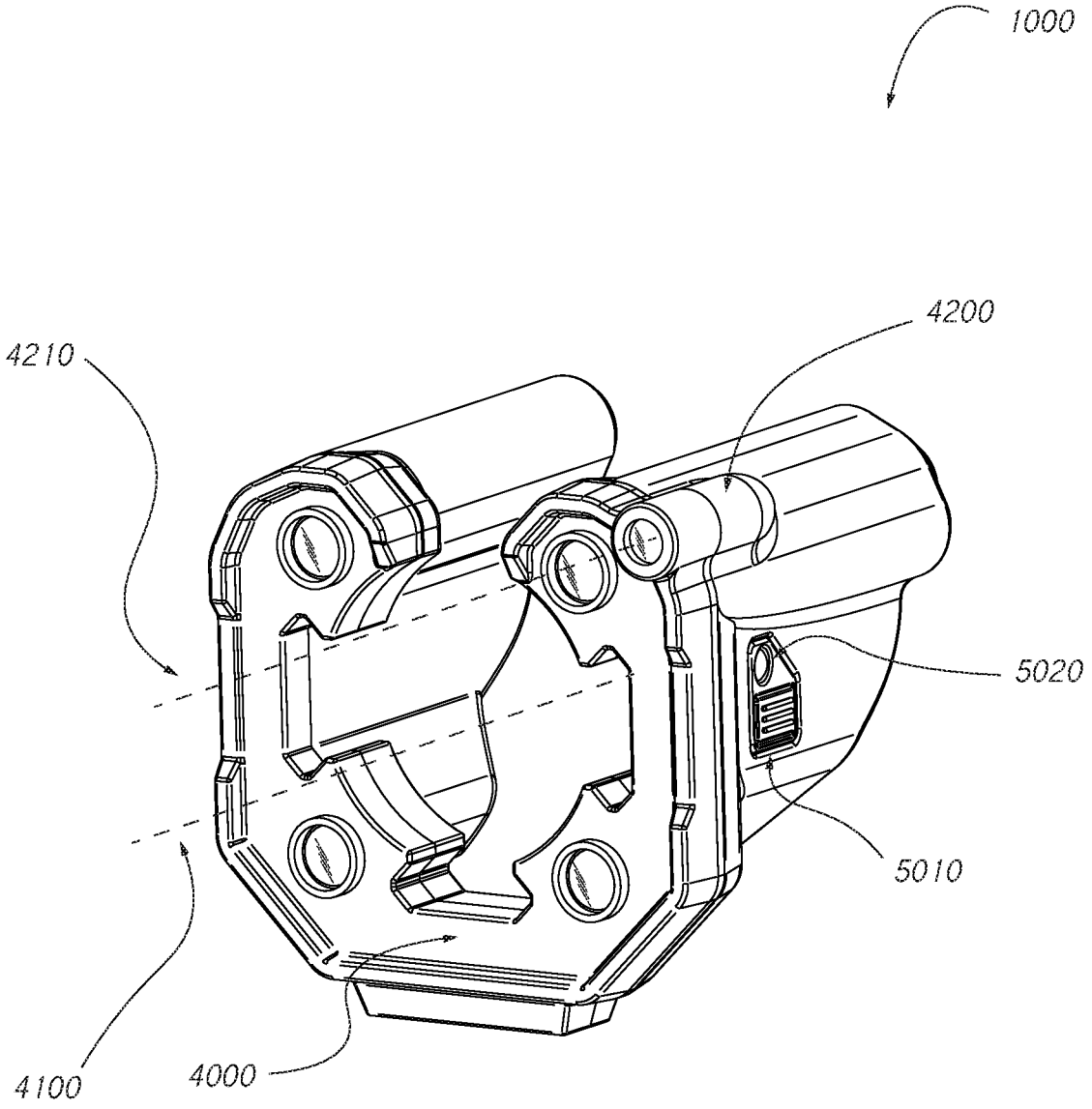

Certain embodiments of the present invention, such as shown in FIG. 4, comprise a weapon mountable illumination device 1000 having a plurality of lighting elements 1200 interconnected with a forward aspect 4000 of the cuff form wherein the lighting elements 1200 are configured to shine forward. In certain embodiments four lighting elements are equidistantly radially offset from a central axis 4100 of the pathway and are angularly offset from each other in 90-degree increments.

Certain embodiments of the present invention, as shown in FIG. 4, comprise a weapon mountable illumination device 1000 further comprising a laser 4200 configured to emit a beam 4210 of light parallel to a central axis 4100 of a pathway of the cuff form. The laser of such embodiments is useful in visual feedback of on-target aiming. In certain embodiments the beam 4210 is adjustable to allow for the correction of parallax error between the beam and the aimpoint of a firearm for a desired distance.

Figure 5:
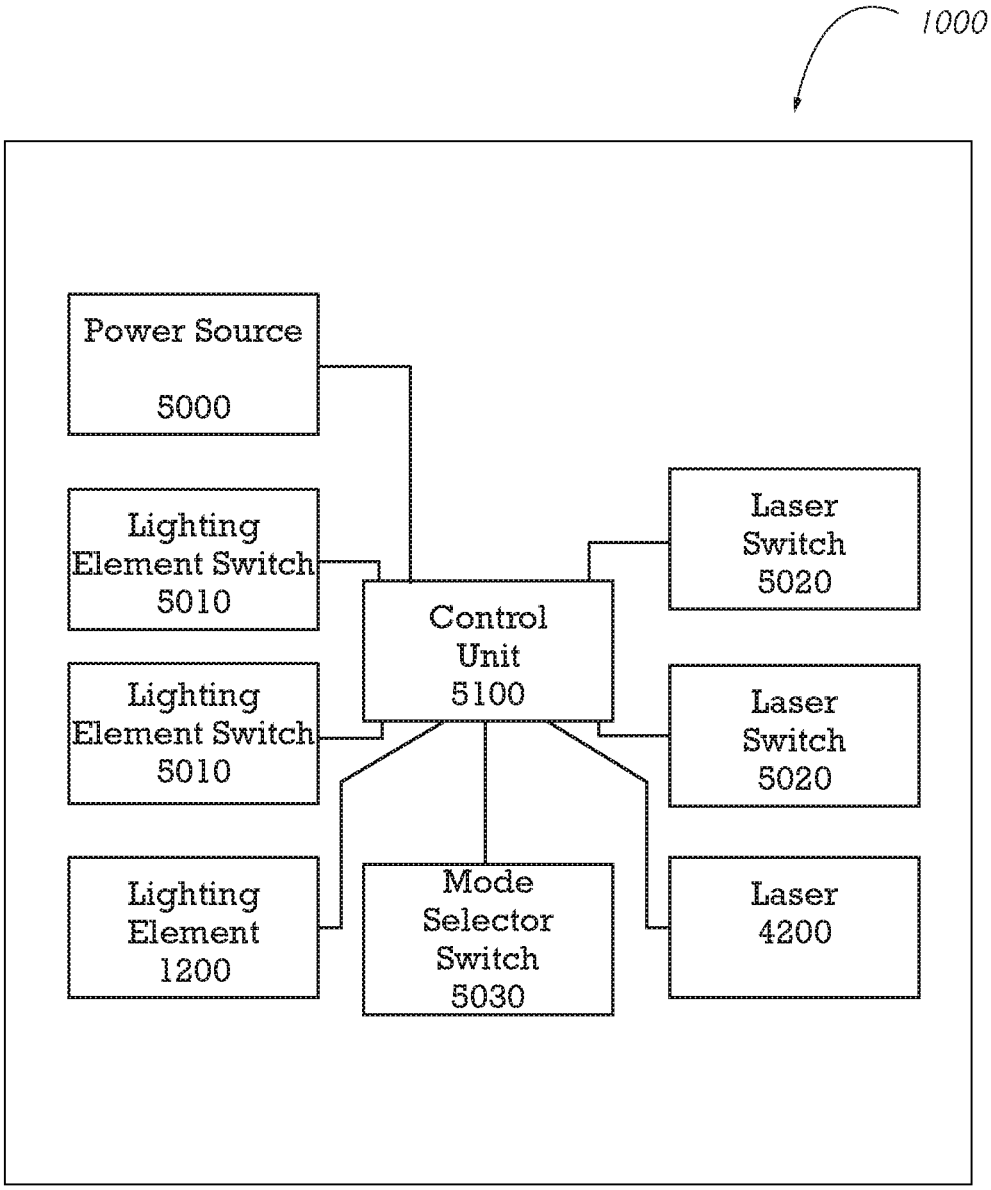

Certain embodiments of the present invention, shown in FIG. 4 and FIG. 5, comprise a weapon mountable illumination device 1000 which further comprises a power source 5000, a lighting element switch 5010 for operating a lighting element 1200, and a laser switch 5020 for operating a laser 4200—each with connection to a control unit 5100. The power source 5000 typically comprises a battery or plurality of batteries although alternate forms of power source are within the spirit and scope of the present invention.

Figure 6:
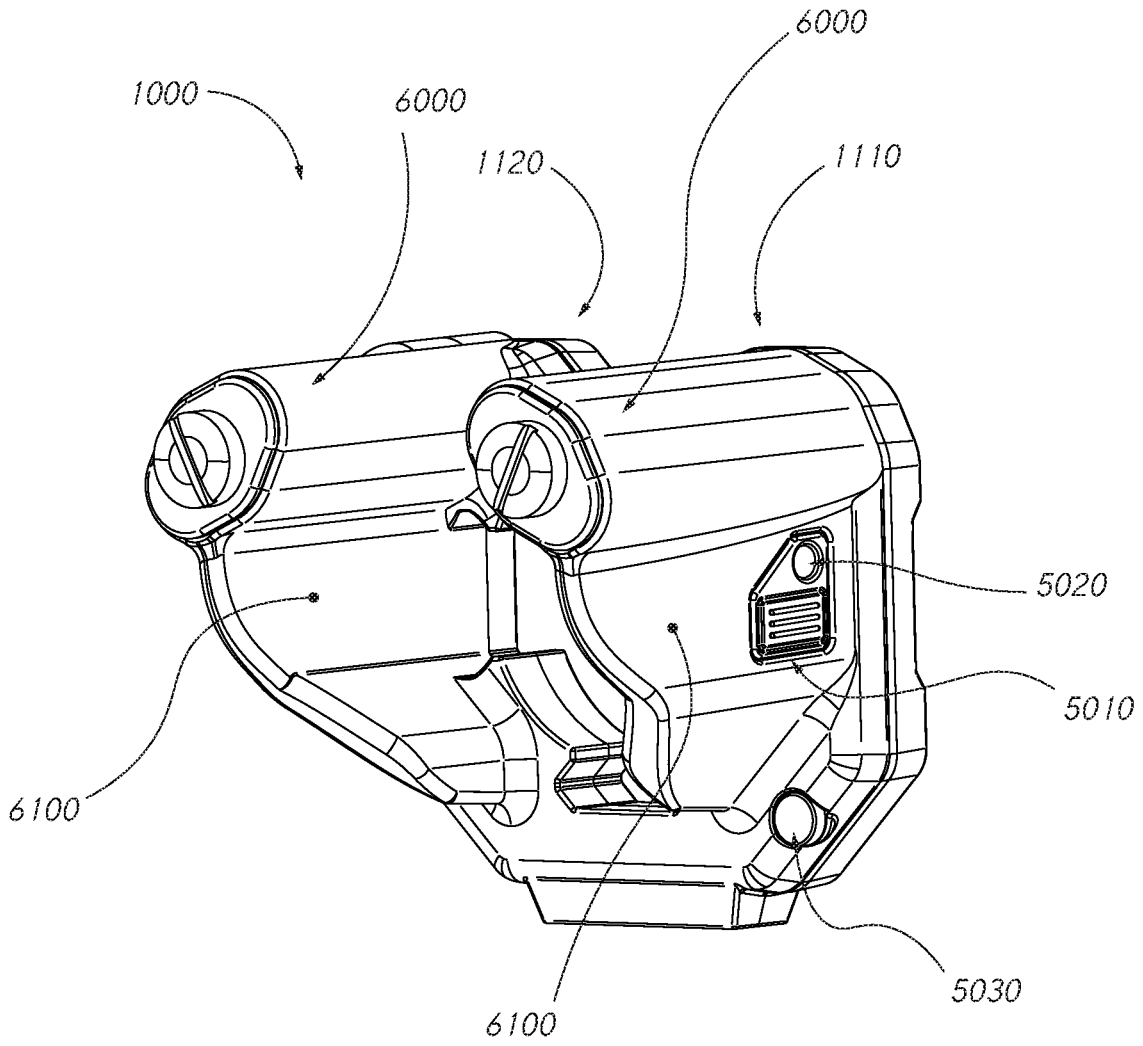

Certain embodiments of the present invention, shown in FIG. 5-FIG. 6, comprise a weapon mountable illumination device 1000 further comprising a third switch 5030 having connection with the control unit 5100 wherein the third switch 5030 allows an operator to select between operational modes of the lighting elements. The third switch 5030 of certain embodiments comprise a push button wherein each press of the button advances the mode to the next mode in a sequence of selectable modes, while other embodiments comprise a rotary switch wherein each of a plurality of positions selects a particular mode associated with that position.

Figure 7A:
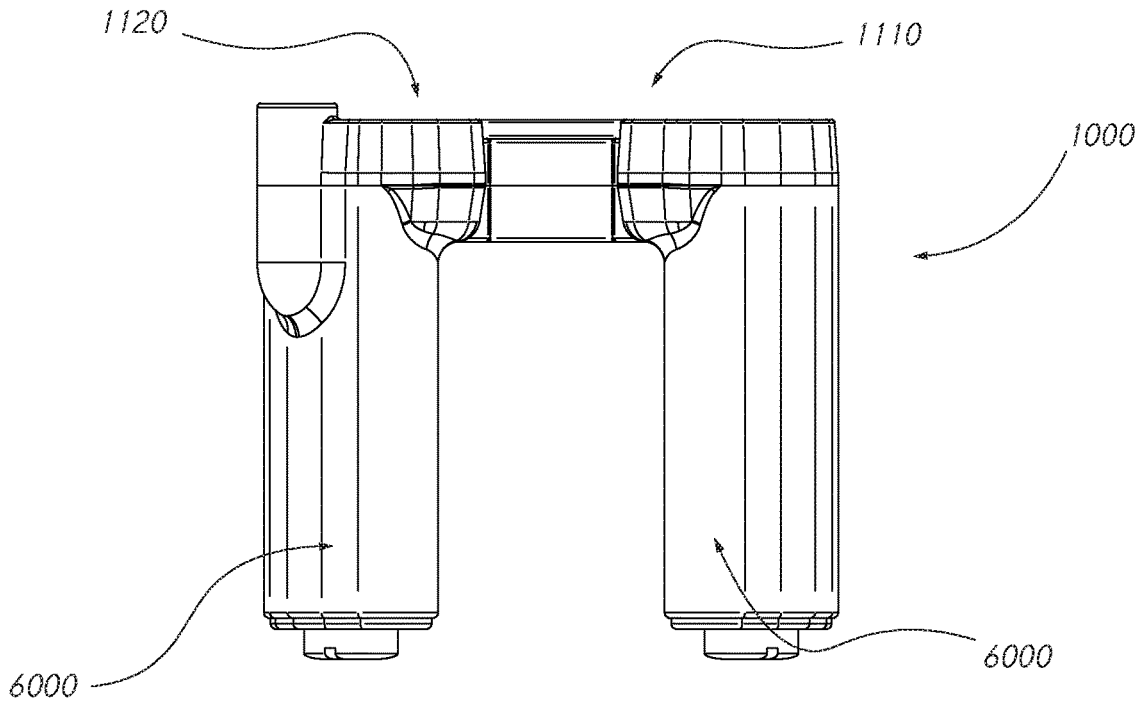
Figure 7B:
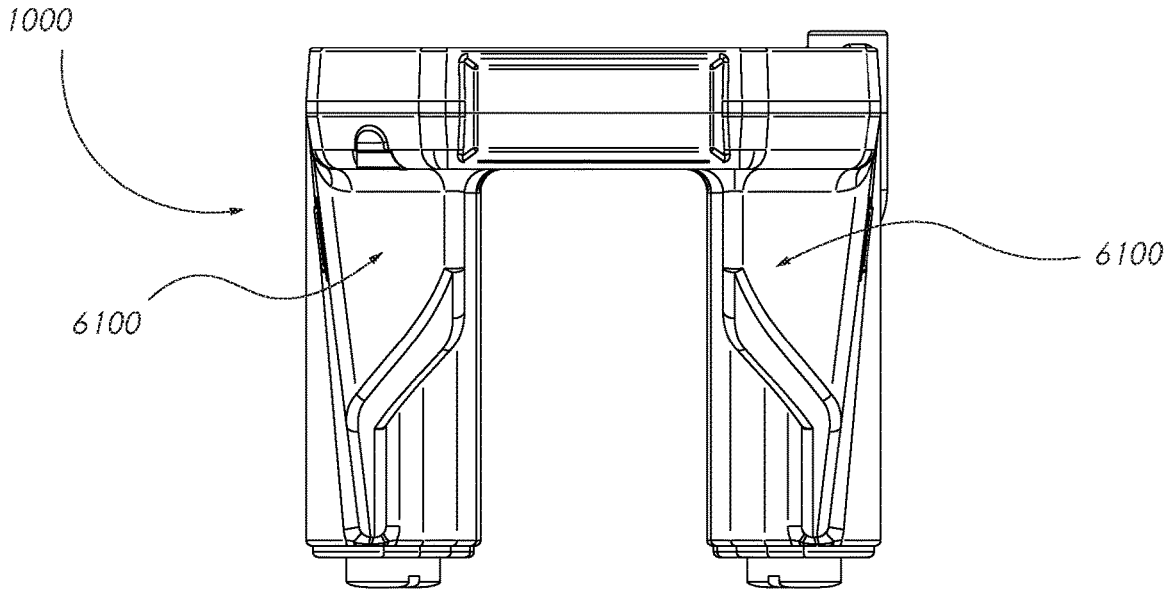

Certain embodiments of the present invention, shown in FIG. 6-FIG. 7A for example, comprises at least one battery compartment 5000 interconnected with the cuff form 1100. In certain embodiments, as shown, a first battery compartment 6000 extends rearward form the first end 1110 of the cuff form and a second battery compartment 6000 extends rearward from the second end 1120 of the cuff form. The battery compartment 6000 of certain embodiments is waterproof while alternate embodiments comprise a battery compartment which is water resistant when the battery compartment is closed.

Figure 7C:
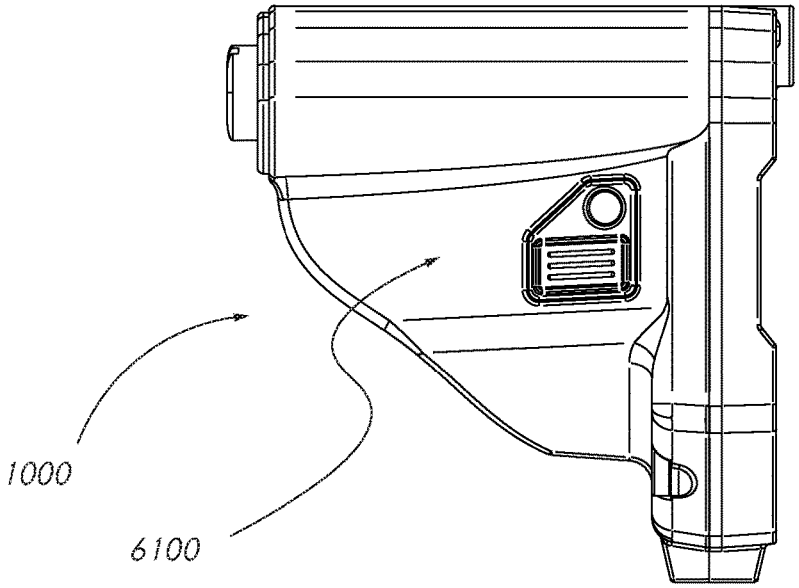
Figure 7D:
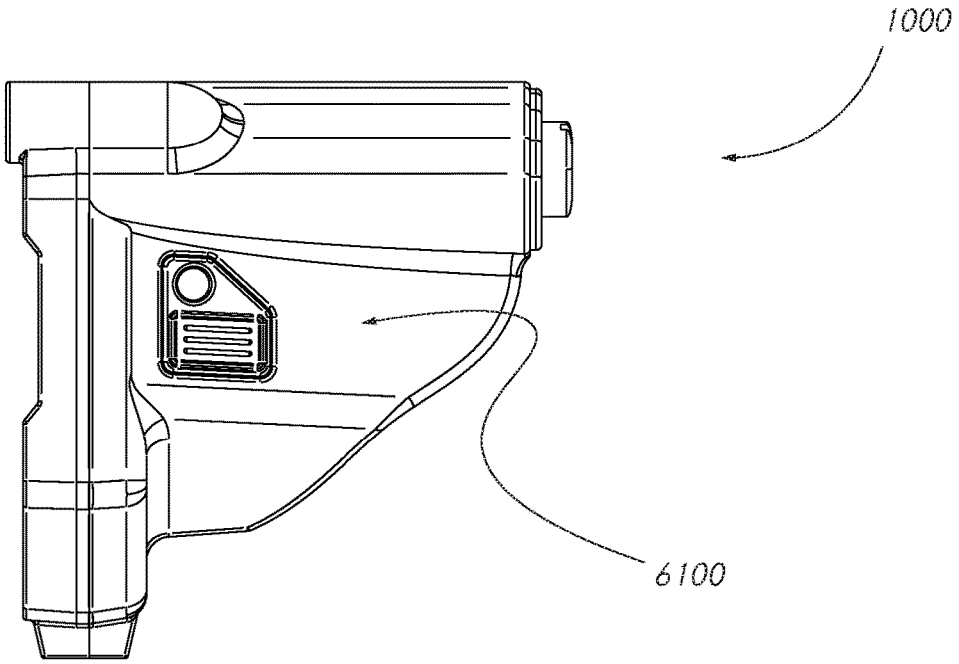

Certain embodiments, shown in FIG. 6-FIG. 7D for example, of the present invention comprise a weapon mountable illumination device 1000 having at least one gusset 6100 interconnected between a battery compartment 6000 and the cuff form 1100. Certain embodiments, as shown comprise a first gusset 6100 interconnected between a first battery compartment 6000 and the cuff form 1100, and a second gusset 6100 interconnected between a second battery compartment 6000 and the cuff form 1100. In certain embodiments the gussets 6100 are swept radially inward to provide a lower profile to reduce snagging. It will be appreciated that the gussets as disclosed provide at least one of the following: added rigidity, lower snagging risk, increased volume to address buoyancy, added surface area for an operator to place their hand.

In certain embodiments, seen in FIG. 7C-7D for instance, a first gusset 6100 comprises a first lighting element switch 5010 and a first laser switch 5020, and a second gusset 6100 comprises a second lighting element 5010 switch and a second laser switch 5020, wherein the lighting element switches 5010 switches have identical functionality to each other, and the second lighting element switches 5020 have identical functionality to each other—thus providing ambidextrous operation of the weapon mountable illumination device.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A weapon mountable illumination device comprising:

a cuff form comprising a gap between a first end, and a second end;

a first open side- and a second open side along a longitudinal axis, and a pathway along the longitudinal axis extending between the first open side and the second open side;

four lighting elements configured to shine forward, wherein the lighting elements have an angular offset of 90-degrees from each other;

wherein the four lighting elements are characterized as non-direction; and the cuff form comprising an internal perimeter, wherein the internal perimeter of the cuff form is configured to interconnect with a forward aspect of a firearm.

2. The weapon mountable illumination device of claim 1, wherein the lighting elements are equidistantly radially offset from a central axis of the pathway.

3. The weapon mountable illumination device of claim 1 further comprising a laser, wherein the laser is configured to emit toward a forward end of the firearm.

4. The weapon mountable illumination device of claim 3, further comprising:

a power source;

a control unit;

a first lighting element switch; and a first laser switch, wherein the power source, switches, lighting element, and laser each having electrical connection to the control unit, wherein the first lighting element switch operates the lighting element, and wherein the first laser switch operates the laser.

5. The weapon mountable illumination device of claim 4, further comprising a modality switch;

the modality switch having electrical connection to the control unit, wherein the modality switch selects an operational mode for the lighting element.

6. The weapon mountable illumination device of claim 5, wherein the modality switch comprises a rotary switch having a plurality of positions.

7. The weapon mountable illumination device of claim 4, further comprising a first battery compartment and a second battery compartment;

the battery compartments are aligned with the first end and the second end of the cuff form and extend rearward.

8. The weapon mountable illumination device of claim 7 wherein, the weapon mountable illumination device is water-resistant.

9. The weapon mountable illumination device of claim 7 wherein, the weapon mountable illumination device is water-proof.

10. The weapon mountable illumination device of claim 7, further comprising:

a first gusset interconnected between the first battery compartment and the cuff form; and a second gusset interconnected between the second battery compartment and the cuff form.

11. The weapon mountable illumination device of claim 10, further comprising:

a second lighting element switch; and a second laser switch, wherein the first lighting element switch and the first laser switch are on an external surface of the first gusset, and wherein the second lighting element switch and the second laser switch are on an external surface of the second gusset.

12. The weapon mountable illumination device of claim 1, wherein the internal perimeter of the cuff comprises a first channel.

13. The weapon mountable illumination device of claim 12, wherein the first channel comprises undercut sidewalls.

14. The weapon mountable illumination device of claim 13, wherein the first channel has an angular offset of 180-degrees from the gap.

15. The weapon mountable illumination device of claim 14, wherein the internal perimeter of the cuff form further comprises a second channel, and a third channel;

the second channel has an angular offset of 90-degrees from the gap;

the third channel has an angular offset of 270-degrees from the gap; and the second channel and the third channel comprise undercut sidewalls.

16. The weapon mountable illumination device of claim 15, further comprising a set screw extending from an external perimeter of the cuff form, through to the internal perimeter of the cuff form, wherein the set screw is configured to affix the weapon mountable illumination device in place.

17. The weapon mountable illumination device of claim 15, further comprising a plurality of set screws extending from an external perimeter of the cuff form, through to the internal perimeter of the cuff form, wherein the set screws are configured to affix the weapon mountable illumination device in place.

18. A weapon mountable illumination device comprising:

a cuff form comprising a gap between a first end, and a second end;

a first open side, and a second open side along a longitudinal axis, and a pathway along the longitudinal axis extending between the first open side and the second open side;

four lighting elements configured to shine forward, the lighting elements equidistantly radially offset from a central axis of the pathway, and the lighting elements having an angular offset of 90-degrees from each other;

an internal perimeter of the cuff form comprising three channels having undercut sidewalls; at intervals of the channels are angularly offset from the gap 90-degrees, 180-degrees, and 270-degrees from the gap;

a laser configured to emit forward, and parallel with the central axis of the pathway;

a power source;

a control unit;

a first lighting element switch, and a second lighting element switch, which operate the lighting elements; and a first laser switch, and a second laser switch, which operate the laser;

a modality switch comprising a rotatory switch with a plurality of positions;

the power source, the switches, the lighting elements, and the laser each having electrical connection to the control unit;

a first battery compartment and a second battery compartment, the battery compartments are aligned with the first end and the second end of the cuff form and extend rearward;

a first gusset interconnected between the first battery compartment and the cuff form; and a second gusset interconnected between the second battery compartment and the cuff form;

wherein the first lighting element switch and the first laser switch are on an external surface of the first gusset, and wherein the second lighting element switch and the second laser switch are on an external surface of the second gusset.

* * * * *